US009495840B2

(12) United States Patent
Naito et al.

(10) Patent No.: US 9,495,840 B2
(45) **Date of Patent: *Nov. 15, 2016**

(54) SYSTEM AND METHOD OF AWARDING A COMMUNITY AWARD

(71) Applicant: Konami Gaming, Inc., Las Vegas, NV (US)

(72) Inventors: Akihiko Naito, Las Vegas, NV (US); Michael Ratner, Las Vegas, NV (US); Edward Sepich, Henderson, NV (US); Thomas Soukup, Las Vegas, NV (US); Yuji Taniguchi, Henderson, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/323,735

(22) Filed: Jul. 3, 2014

(65) Prior Publication Data

US 2015/0087399 A1 Mar. 26, 2015

(30) Foreign Application Priority Data

Sep. 20, 2013 (AU) ..... 2013231107

(51) Int. Cl.
*A63F 9/00* (2006.01)
*G07F 17/32* (2006.01)

(52) U.S. Cl.
CPC ..... *G07F 17/3272* (2013.01); *G07F 17/3258* (2013.01)

(58) Field of Classification Search
None
See application file for complete search history.

(56) References Cited

U.S. PATENT DOCUMENTS

| | | | | |
|---|---|---|---|---|
| 6,663,487 | B1 | 12/2003 | Ladner | |
| 7,628,691 | B2 | 12/2009 | Luciano, Jr. et al. | |
| 7,824,260 | B2 | 11/2010 | Aida | |
| 8,052,515 | B2 | 11/2011 | Nakamura | |
| 8,096,869 | B2 | 1/2012 | Yoshimi | |
| 8,292,719 | B2 * | 10/2012 | Englman et al. | 463/16 |
| 8,303,397 | B2 | 11/2012 | Mizue | |

(Continued)

FOREIGN PATENT DOCUMENTS

| | | | |
|---|---|---|---|
| JP | 2015058350 | A2 | 3/2005 |
| WO | 2012/139194 | A1 | 10/2012 |

OTHER PUBLICATIONS

Patent Examination Report No. 1 (AU 2013231107)—Date of Issue Nov. 4, 2013.

(Continued)

*Primary Examiner* — Seng H Lim
(74) *Attorney, Agent, or Firm* — Howard & Howard Attorneys PLLC

(57) ABSTRACT

A system providing a community award to player is disclosed. The system comprises a plurality of gaming machines and a system controller. Each gaming machine is configured receive a wager from a respective player and responsively initiate a game. The system controller is coupled to each of the gaming machines and includes a database with a community awards list including a plurality of total award amounts, each total award amount associated with a corresponding number of players. The system controller is then configured to detect a triggering condition; responsively determine a number of players playing the plurality of gaming machines; determine a total award as a function of the determined number of players and the community award list; and provide a community award to at least one of the plurality of players as a function of the determined total award.

23 Claims, 7 Drawing Sheets

(56) References Cited

U.S. PATENT DOCUMENTS

| | | | | |
|---|---|---|---|---|
| 8,460,087 | B2 | 6/2013 | Michel | |
| 2002/0107068 | A1* | 8/2002 | Baerlocher et al. | 463/20 |
| 2003/0008705 | A1* | 1/2003 | Baerlocher et al. | 463/20 |
| 2003/0069071 | A1 | 4/2003 | Britt et al. | |
| 2004/0090003 | A1 | 5/2004 | Snow | |
| 2004/0214628 | A1* | 10/2004 | Boyd et al. | 463/20 |
| 2005/0153773 | A1* | 7/2005 | Nguyen et al. | 463/25 |
| 2006/0040723 | A1* | 2/2006 | Baerlocher et al. | 463/16 |
| 2006/0058099 | A1 | 3/2006 | Soukup et al. | |
| 2007/0105619 | A1* | 5/2007 | Kniesteadt et al. | 463/26 |
| 2008/0076527 | A1* | 3/2008 | Low et al. | 463/25 |
| 2009/0117984 | A1* | 5/2009 | Seelig | G07F 17/3211 463/20 |
| 2010/0216541 | A1* | 8/2010 | Boyd et al. | 463/20 |
| 2011/0111826 | A1* | 5/2011 | Baerlocher | G07F 17/3244 463/20 |
| 2011/0223985 | A1 | 9/2011 | Mizue | |
| 2013/0005428 | A1 | 1/2013 | Kelly | |
| 2013/0296022 | A1 | 11/2013 | Soukup et al. | |

OTHER PUBLICATIONS

Patent Examination Report No. 2 (AU 2013231107)—Date of Issue Feb. 11, 2014.

Patent Examination Report No. 1 (AU 2014210679); Date of Issue: Sep. 12, 2014.

Patent Examination Report No. 3 (AU 2014210679); Date of Issue: Sep. 9, 2015.

Patent Examination Report No. 4 (AU 2014210679); Date of Issue: Sep. 14, 2015.

Japanese Office Action dated Oct. 6, 2015 for Japanese Patent Application No. 2014-147013.

Notice of Reasons for Rejection with English Translation (JP 2014-147013) Dispatched: Jul. 5, 2016.

* cited by examiner

SYSTEM AND METHOD OF AWARDING A COMMUNITY AWARD

CROSS REFERENCE TO RELATED APPLICATION

This application claims priority to Australian Patent Application No. 2013231107, filed Sep. 20, 2013, the disclosure of which is hereby incorporated by reference in its entirety.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The invention generally relates to systems and methods for providing system based community award.

BACKGROUND OF THE INVENTION

Gaming machines, such as slot machines, are a cornerstone of the gaming industry. Many gaming system provide for addition incentive through the use of bonus and secondary games in order to continually entice a player to return for addition gameplay. Over time though, many game begin to lose appeal to players due to static awards and game rules. Other games system implement additional networked components such as progressive awards and player tracking awards in order to provide additional incentives to player to continue playing a particular game or machine.

The present invention is aimed at one or more of the problems identified above.

BRIEF SUMMARY OF INVENTION

In one aspect of the present invention, a system providing a community award to player is disclosed. The system comprises a plurality of gaming machines and a system controller. Each gaming machine is configured receive a wager from a respective player and responsively initiate a game. The system controller is coupled to each of the gaming machines and includes a database with a community awards list including a plurality of total award amounts, each total award amount associated with a corresponding number of players. The system controller is then configured to detect a triggering condition; responsively determine a number of players playing the plurality of gaming machines; determine a total award as a function of the determined number of players and the community award list; and provide a community award to at least one of the plurality of players as a function of the determined total award.

In another aspect of the present invention, a method of providing an award to a player is disclosed. The method comprises the steps of: the system controller responsively determining a number of players playing the plurality of machines; the system controller determining a total award as a function of the determined number of players and the community award list; and the system controller providing a community award to at least one of the plurality of players as a function of the determined total award.

In another aspect of the present invention, a non-transitory information recording medium containing a computer readable program is provided that functions as a system comprising a system controller. Each gaming machine is configured receive a wager from a respective player and responsively initiate a game. The system controller is coupled to a plurality of gaming machines and includes a database with a community awards list including a plurality of total award amounts, each total award amount associated with a corresponding number of players. Each gaming machine is configured receive a wager from a respective player and responsively initiate a game. The system controller is then configured to detect a triggering condition; responsively determine a number of players playing the plurality of gaming machines; determine a total award as a function of the determined number of players and the community award list; and provide a community award to at least one of the plurality of players as a function of the determined total award.

In another aspect of the present invention, a system providing a community award to player is disclosed. The system comprises a plurality of gaming machines and a system controller. Each gaming machine is configured receive a wager from a respective player and responsively initiate a game. The system controller is coupled to each of the gaming machines and includes a database with a community awards list including a plurality of total award probabilities, each total award probability associated with a corresponding number of players. The system controller is then configured to detect a triggering condition; responsively determine a number of players playing the plurality of gaming machines; determine a total award probability as a function of the determined number of players and the community award list; and provide a community award to at least one of the plurality of players as a function of the determined total award probability.

In another aspect of the present invention, a method of providing an award to a player is disclosed. The method comprises the steps of: the system controller responsively determining a number of players playing the plurality of machines; the system controller determining a total award probability as a function of the determined number of players and the community award list; and the system controller providing a community award to at least one of the plurality of players as a function of the determined total award probability.

In another aspect of the present invention, a non-transitory information recording medium containing a computer readable program is provided that functions as a system comprising a system controller. Each gaming machine is configured receive a wager from a respective player and responsively initiate a game. The system controller is coupled to a plurality of gaming machines and includes a database with a community awards list including a plurality of total award probabilities, each total award probability associated with a corresponding number of players. Each gaming machine is configured receive a wager from a respective player and responsively initiate a game. The system controller is then configured to detect a triggering condition; responsively determine a number of players playing the plurality of gaming machines; determine a total award probability as a function of the determined number of players and the community award list; and provide a community award to at least one of the plurality of players as a function of the determined total award probability.

BRIEF DESCRIPTION OF THE DRAWINGS

Other advantages of the present invention will be readily appreciated as the same becomes better understood by reference to the following detailed description when considered in connection with the accompanying drawings.

Corresponding reference characters indicate corresponding parts throughout the drawings.

DETAILED DESCRIPTION OF THE INVENTION

With reference to the drawings and in operation, the present invention overcomes at least some of the disadvantages of known gaming systems and methods by providing a community award to player. The system comprises a plurality of gaming machines and a system controller. Each gaming machine is configured receive a wager from a respective player and responsively initiate a game. The system controller is coupled to each of the gaming machines and includes a database with a community awards list including a plurality of total award amounts, each total award amount associated with a corresponding number of players. The system controller is then configured to detect a triggering condition; responsively determine a number of players playing the plurality of gaming machines; determine a total award as a function of the determined number of players and the community award list; and provide a community award to at least one of the plurality of players as a function of the determined total award.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

System Generally

Figure 1:
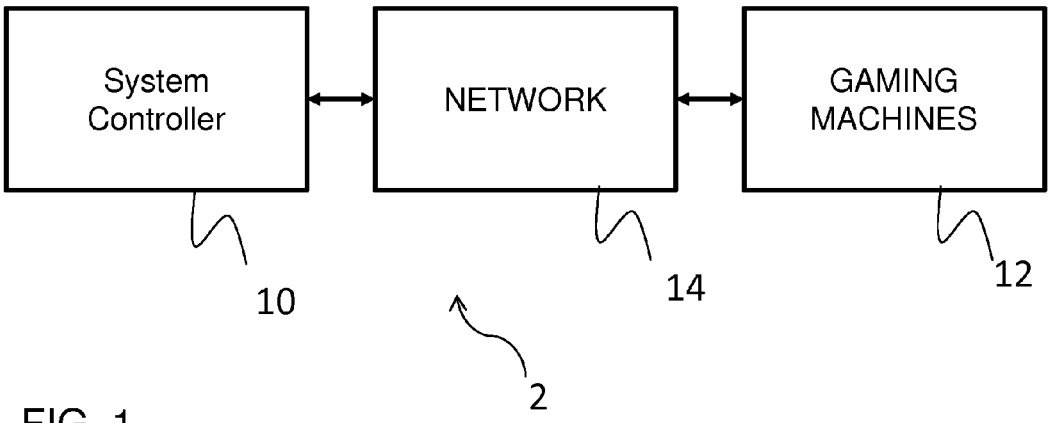
FIG. 1 is a diagram of a system for awarding a community award, according to an embodiment of the present invention.

FIG. 1 is a schematic view of an exemplary system 2. The system 2 includes a system controller 10 and two or more gaming machines 12. The gaming system 2 may also include a network 14 for communication between the system controller 10 and the gaming machines 12. In one embodiment, at least one of the gaming machines 12 is a video gaming machine. In another embodiment, the at least one gaming machine 12 may include a personal computer, laptop, cell phone, smart phone, tablet computer, personal data assistant, and/or any suitable computing device that enables a player to connect to the network 14.

In the illustrated embodiment, the network 14 comprises a local area network (LAN). Alternatively, the network 14 may also comprise alternate modes of digital communication, for example, an Internet link, an intranet, a WAN, dial-in-connections, cable modems, wireless modems, and/or ISDN lines. In the illustrated embodiment, the system 2 includes a plurality gaming machines 12, which in one embodiment are arranged in a bank, i.e., are arranged together, adjacently (not shown). It should be noted, however, that the gaming system 2 may include any number of gaming machines 12 that may be arranged in any manner, such as in a circle or along a curved arc, or positioned within separate areas of a casino floor, and/or separate gaming establishments such as different casinos. Furthermore, additional groups or banks of gaming machines 12 may be coupled to the network 14. Furthermore, the system 2 may encompass or be used across more than one property or casinos. Each property includes groups or banks of gaming machines 12 connected to the network 14. The network 14 may be any suitable form or architecture. For example, subsets of groups or banks of gaming machines 12 may be linked to a local server which is linked to other servers (local or located at another property, casino, or remote location).

In one embodiment, the system 2 may also include a player tracking system and method may be embodied or implemented, at least in part, via an entertaining and monitoring system. The entertainment and monitoring system may include additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT). The player tracking system will be discussed in further detail below. Exemplary entertainment and monitoring and/or player tracking systems are disclosed in commonly owned, U.S. patent application Ser. No. 13/826,991, filed on Mar. 14, 2013, U.S. Patent Application Publication No. 2006/0058099A1, and U.S. Patent Application Publication No. 2003/0069071A1, all of which are hereby incorporated by reference.

As shown, the system 2 includes a plurality of gaming machines 12. Gaming machines 12 may include, but are not limited to gaming machines, electronic gaming machines (such as video slot, video poker machines, or video arcade games), electric gaming machines, virtual gaming machines, e.g., for online gaming, an interface to a table management system (not shown) for table games, or other suitable devices at which a patron or player 224 may interact or access a user or player account. In the illustrated embodiment, one electronic gaming device or machine is shown. However, it should be noted that the present invention is not limited to any number or type of gaming machines 12. In one embodiment, the gaming machines 12 are organized into banks (not shown), each bank containing a plurality of gaming machines 12. The game machine 12 and its operation will be discussed in further detail below.

Gaming Machine

Figure 2:
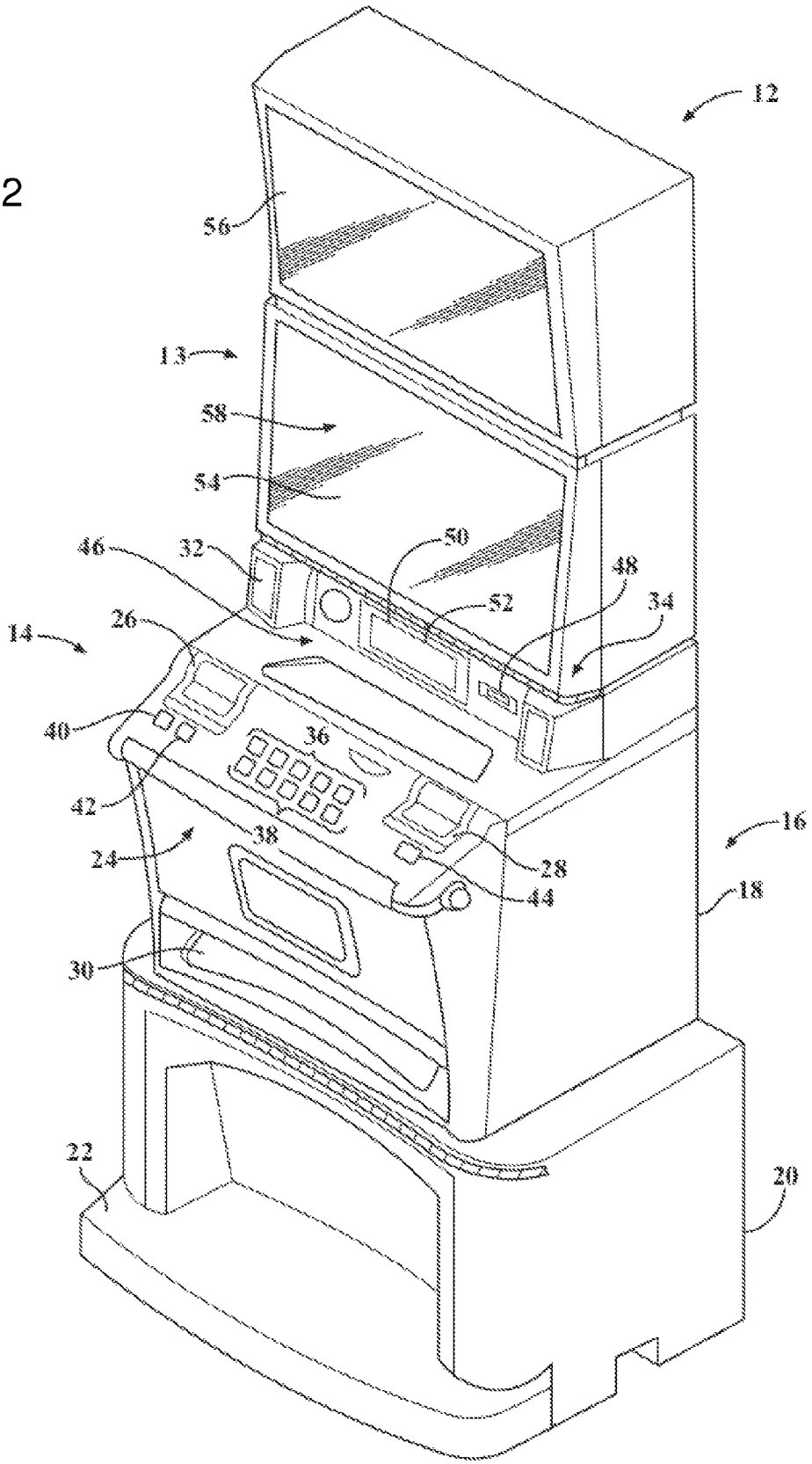
FIG. 2 is a perspective view of an exemplary gaming machine for use in the system of FIG. 1.
Figure 3:
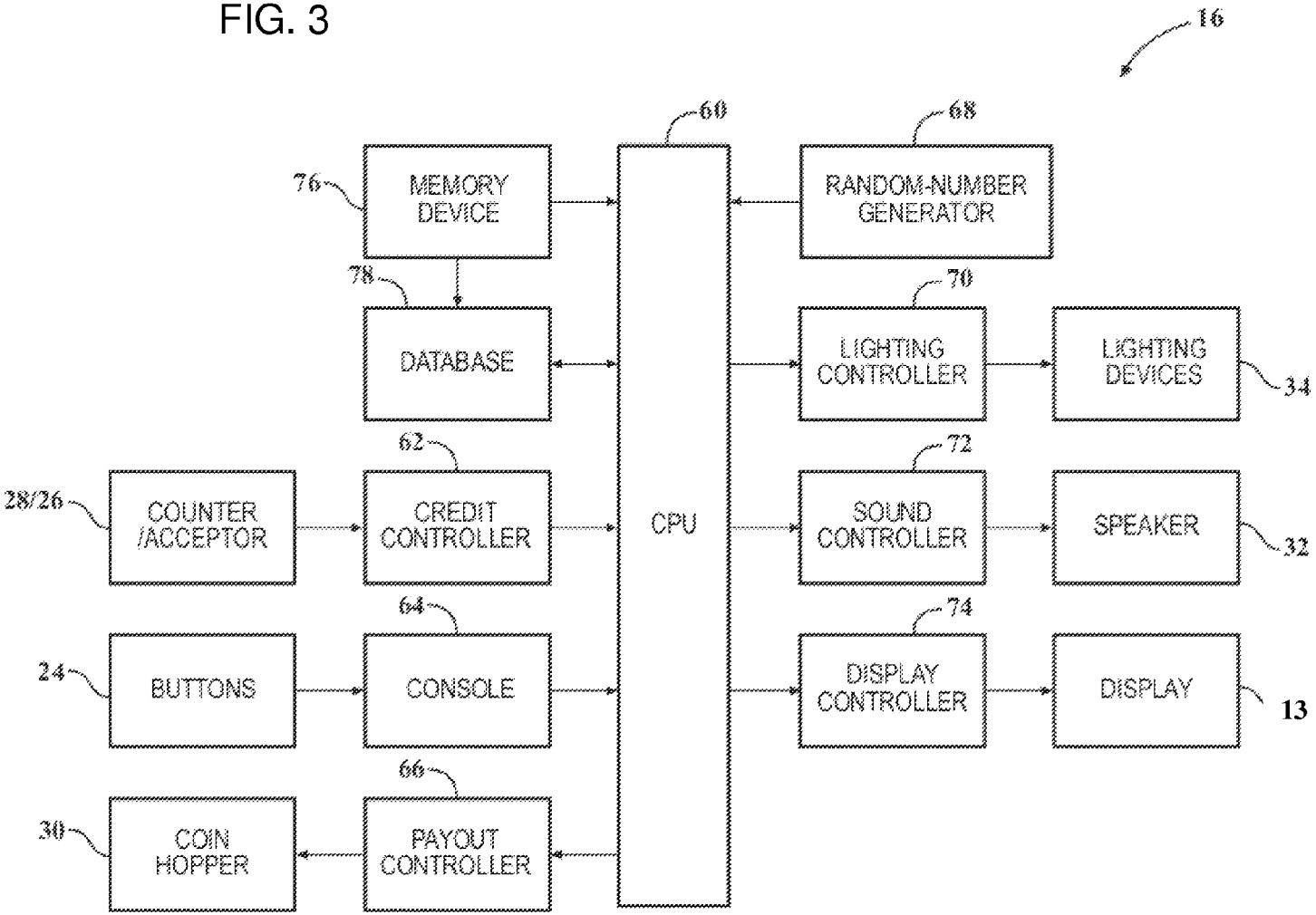
FIG. 3 is a schematic showing the structure of the gaming machine according to the first embodiment.

FIG. 2 is a perspective view of an exemplary gaming machine 12. FIG. 3 is a schematic representation of the gaming machine 12. A preferred embodiment of the present invention is a video gaming machine preferably installed in a casino. In the illustrated embodiment, the gaming machine 12 includes a display device 13 for displaying a plurality of games, a user input device 14 to enable a player to interface with the gaming machine 12, and a gaming controller 16 that is operatively coupled to the display device 12 and the user input device 14 to enable a player to play games displayed on the display device 13. The gaming machine 12 also includes a cabinet assembly 18 that is configured to support the display device 13, the user input device 14, and/or the gaming controller 16 from a gaming stand 20 and/or a supporting surface 22.

The display device 12 and the user input device 14 are coupled to the cabinet assembly 18 and are accessible by the player. In one embodiment, the gaming controller 16 is positioned within the cabinet assembly 18. Alternatively, the gaming controller 16 may be separated from the cabinet assembly 18, and connected to components of the gaming machine 12 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 24, a coin slot 26, and/or a bill acceptor 28. The coin slot 26 includes an opening that is configured to receive coins and/or tokens deposited by the player into the gaming machine 12. The gaming machine 12 converts a value of the coins and/or tokens to a corresponding amount of gaming credits that are used by the player to wager on games played on the gaming machine 12.

The bill acceptor 28 includes an input and output device that is configured to accept a bill, a ticket, and/or a cash card into the bill acceptor 28 to enable an amount of gaming credits associated with a monetary value of the bills, ticket, and/or cash card to be credited to the gaming machine 12. Moreover, the gaming machine 12 may also utilize a cashless wagering system (not shown), such as a ticket in ticket out (TITO) system (not shown). In one embodiment, the bill acceptor 28 also includes a printer (not shown) that is configured to dispense a printed voucher ticket that includes information indicative of an amount of credits and/or money paid out to the player by the gaming machine 12 during a gaming session. The voucher ticket may be used at other gaming machines, or redeemed for cash, and/or other items as part of a casino cashless system (not shown).

A coin tray 30 is coupled to the cabinet assembly 18 and is configured to receive a plurality of coins that are dispensed from the gaming machine 12. One or more speakers 32 are installed inside the cabinet assembly 18 to generate voice announcements and/or sound effects associated with game play. The gaming machine 12 also includes one or more lighting devices 34 that are configured to blink and/or change brightness and color in specific patterns to produce lighting effects to enhance a visual gaming experience for the player.

In one embodiment, the input buttons 24 include a plurality of BET switches 36 for inputting a wager on a game, a plurality of selection switches 38 for selecting a betting line and/or card, a MAXBET switch 40 for inputting a maximum wager, a PAYOUT switch 42 for ending a gaming session and dispensing accumulated gaming credits to the player, and a start switch, i.e., a SPIN/DEAL button 44 to initiate an output of a game.

In the illustrated embodiment, the BET switches 36 include five switches from 1BET to 5BET to enable a player to wager between a minimum bet up to 5× minimum bet. Each selection switch 38 corresponds to a betting line such as, for example, a payline and/or symbol for a reel game, one or more cards for a card game, and/or a symbol for a roulette game, to enable a player to associate a wager with one or more betting lines. The MAXBET switch 40 enables a player to input the maximum bet that a player can spend against one time of a game. The PAYOUT switch 42 enables a player to receive the amount of money and/or credits awarded to the player during a gaming session, which has been credited onto the gaming machine 12.

The gaming machine 12 may also include a player tracking device 46 that is coupled to the gaming controller 16 for identifying the player and/or a player tracking account 209 that is associated with the player 224. The player tracking account 209 may include, but is not limited to, gaming credits available to the player for use in playing the gaming machine 12. The player tracking device 46 is configured to communicate player account information 209 between a player tracking server 201 and the gaming machine 12. For example, the player tracking device 46 may be used to track bonus points and/or credits awarded to the player during a gaming session and/or track bonus and/or credits downloaded to the gaming machine 12 from the player tracking system. The player tracking device 46 may also be used to identify the player across the network 14 among additional groups of gaming machines 12. Identifying the player across the network 14 allows for the awarding of and/or distribution of community awards based on determining the number players across multiple groups of gaming machines 12 connected to network 14.

The player tracking device 46 is coupled to the gaming cabinet assembly 18 and includes a player identification card reader 48, a data display 50, and a keypad 52. The player identification card reader 48 is configured to accept a player tracking card (not shown) inserted by the player, and read information contained on the player tracking card to identify the player account information. The player identification card reader 48 may include, but is not limited to, a barcode reader, a magnetic card reader, and/or a radio frequency identification (RFID) card reader. The keypad 52 is configured to accept a user selection input such as, for example, a unique player personal identification number (PIN) to facilitate enabling the gaming machine 12 to identify the player, and access player account information associated with the identified player to be displayed on the data display 50. In one embodiment, the data display 50 includes a touchscreen panel that includes the keypad 52. Alternatively, the data display 50 and the keypad 52 may be included in the display device 13.

In one embodiment, the display device 13 includes a first display 54 and a second display 56. The first display 54 is configured to display a game screen 58 (shown in FIG. 3) including indicia and/or symbols for use in a game, e.g., cards used by a card game, roulette wheel and symbols used in a roulette game, and reels used in a reel game. The game screen 58 may include any type of game including, but not limited to, a video slot game, a keno game, a blackjack game, a video poker game, or any type of game which allows a player to make a wager, play a game, and potentially provide the player an award based on an outcome of the game and a paytable. The second display 56 is configured to display game play instructions for performing the game including, but not limited to, playing instructions, paytables, paylines, betting lines and/or any other information to enable the gaming machine 12 to function as described herein. Moreover, each display 54 and 56 may be configured to display at least a portion of the game screen 58 and/or game play instructions. In one embodiment, the first and second displays 54 and 56 each include a flat panel display, such as a cathode ray tube display (CRT), a liquid crystal display (LCD), a light-emitting diode display (LED), a plasma display, and/or any suitable visual output device capable of displaying graphical data and/or text to a user. Alternatively, a single component, such as a touch screen, may function as both the display device 12 and as the user input device 14. In an alternative embodiment, the first display 54 and/or the second display 56 includes a plurality of mechanical reels displaying a plurality of game symbols.

Referring to FIG. 3, in one embodiment, the gaming controller 16 includes a processor, i.e., a central processing unit (CPU) 60, a credit controller 62, a console unit 64, a payout controller 66, a random-number generator (RNG) 68, a lighting controller 70, a sound controller 72, a display controller 74, a memory device 76, and a database 78. Memory device 76 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 60 to store, retrieve, and/or execute instructions and/or data.

The CPU 60 executes various programs, and thereby controls other components of the gaming controller 16 according to player instructions and data accepted by the user input device 14. The CPU 60 in particular executes a game program, and thereby conducts a game in accordance with the embodiments described herein. The memory device 76 stores programs and databases used by the CPU 60. Moreover, the memory device 76 stores and retrieves information in the database 78 including, but not limited to, a game type, a number of reels associated with a game, a number of reel strips associated with each reel, a number of symbol positions being displayed on each reel strip, a type of symbols being displayed on each symbol position, a predefined set of normal symbols, a predefined set of special symbols, image data for producing game images and/or screens on the display device 12, and temporarily stores variables, parameters, and the like that are used by the CPU 60. In addition, the memory device 76 stores indicia, symbol weights, pay tables, and/or winning combination tables which represent relationships between combinations of random numbers and types of awards. In one embodiment, the memory device 76 utilizes RAM to temporarily store programs and data necessary for the progress of the game, and EPROM to store, in advance, programs and data for controlling basic operation of the gaming machine 12, such as the booting operation thereof.

The credit controller 62 manages the amount of player's credits, which is equivalent to the amount of coins and bills counted and validated by the bill acceptor 28. The console unit 64 is coupled to the user input device 14 to monitor player selections received through the input buttons 24, and accept various instructions and data that a player enters through the input buttons 24. The payout controller 66 converts a player's credits to coins, bills, or other monetary data by using the coin tray 30 and/or for use in dispensing a credit voucher via the bill acceptor 28.

The lighting controller 70 controls one or more lighting devices 34 to blink and/or change brightness and color in specific patterns in order to produces lighting effects associated with game play. The sound controller 72 controls the speakers 32 to output voice announcements and sound effects during game play. The display controller 74 controls the display device 13 to display various images on screens preferably by using computer graphics and image data stored in the memory device 76. More specifically, the display controller 74 controls video reels in a game screen displayed on the first display 54 and/or the second display 56 by using computer graphics and the image data.

The RNG 68 generates and outputs random numbers to the CPU 60 preferably at the start of each round of game. The CPU 60 uses the random numbers to determine an outcome of a game. For example, if the game is a video slot game, the CPU 60 uses the RNG 68 to randomly select an arrangement of symbols to be displayed on video reels. Moreover, the CPU 60 generally uses random numbers generated by the RNG 68 to play the games, and to determine whether or not to provide an award to a player. In addition, the CPU 60 generates game outcomes including combinations of random numbers, and compares the generated combinations with winning combinations stored in the winning combination table to determine if the generated outcome is a winning outcome that is associated with a type of award.

Figure 8:
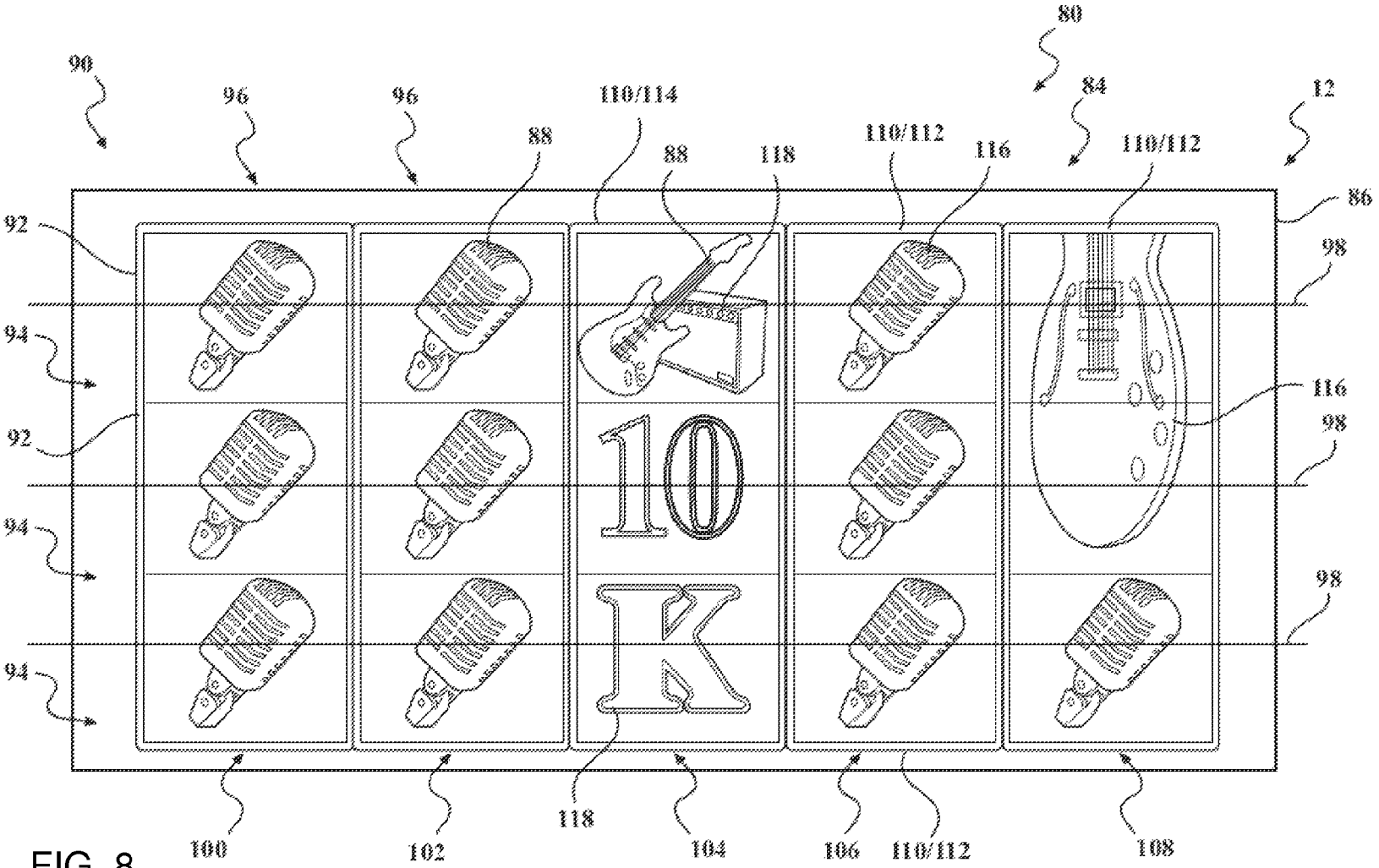
FIG. 8 is a representative drawing of the display grid, according to an embodiment of the present invention.

FIG. 8 is an exemplary graphical display of a game that is displayed by the gaming machine 12 shown in FIG. 2. In the illustrated embodiment, the gaming controller 16 is configured to display the game on the display device 13. In one embodiment, the game includes a main game 80, such as a video slot game. However, it should be noted that the main game 80 may be any type of game upon which a player could make a wager including, but not limited to a keno game, a blackjack game, a video poker game, or any type of game that enables the gaming machine 12 to function as described herein. In the illustrated embodiment, the main game 80 is displayed on the first display 54. Alternatively, the main game 80 may be displayed on the first display 54 and/or the second display 56.

In general, during play of the main game 80, the gaming controller 16 randomly generates an outcome 84 of the main game 80 and displays the generated game outcome 84 in a display area 86. The gaming controller 16 randomly selects a plurality of game symbols 88 from a predefined set of possible game symbols and displays the selected game symbols 88 associated with the generated game outcome 84 in the game display area 86.

In the illustrated embodiment, the plurality of game symbols 88 are displayed in a grid 90 having a plurality of cells 92 arranged along a plurality of rows 94 and a plurality of columns 96. Each cell 92 displays one or more game symbols 88 associated with the game outcome 84. In the illustrated embodiment, the gaming controller 16 displays the game symbols 88 within a plurality of reels 98. Each reel 98 is associated with a corresponding column 96. The main game 80, in one embodiment, includes 5 reels 98 with 3 cells 92 displayed in the display area 86 per reel 98 (a "3×5" arrangement). Alternatively, other reel arrangements may be used such as, for example, 4, 5, 5, 5, and 4 cells per reel, respectively (a "4-5-5-5-4" arrangement), 3-4-3-4-3, or 4-5-4-5-4 arrangements or arrangements with the same number of cells per column, such as 3×3, 3×4, 4×5, or 5×5 configurations. The main game 80 also includes a plurality of paylines 100 that extend across one or more cells 92 to indicate, to the player, a combination of game symbols 88. In one embodiment, the gaming machine 12 displays the main game 80 via a plurality of mechanical reels (not shown) that include a plurality of symbols displayed on a circumferential surface of each reel.

Each slot game is generally played in a conventional manner. The player makes a wager, which may be based on a predetermined denomination and a selected number of paylines, the gaming controller 16 randomly generates an outcome for the game, spins the reels, and selectively stops the reels to display a game symbol 88 in each of the display cells 92. If a predetermined pattern of symbols 88 is randomly chosen for each cell 92 associated with a played payline 100, the player may be awarded a payout based on the payline, the wager, and a predetermined paytable. Moreover, the player may be awarded a payout if the combination of symbols associated with a selected payline is a winning combination. In addition, a player may receive a bonus feature and/or a bonus game based on the combination of symbols associated with the selected payline and/or the appearance of one or more predefined symbols in the game outcome 84. Many variations to the above described general play of a slot game fall within the scope of the present invention. Such slot games are well-known in the art, and are therefore not further discussed.

In the illustrated embodiment, the gaming machine 12 receives a signal, from the user input device 14, that is indicative of a player's selection to initiate a gaming session including a wager amount, and a selection of one or more paylines 100 associated with a predefined set of cells 92 within the displayed grid 90. In the illustrated embodiment, the gaming machine 12 is a multi-line game, i.e., the paylines include horizontal paylines and/or diagonal paylines, and/or zig-zag paylines. Moreover, the user input device 14 may allow the player to toggle to increase the bet per payline a credit at a time (up to the maximum bet). The gaming controller 16 randomly generates an outcome of the main game 80, and displays the generated outcome on the display device 13. In one embodiment, the gaming controller 16 is configured to rotate, and/or spin each reel 98 to initiate a game play, and stop each reel 98 to display a plurality of symbols 88 associated with the randomly generated outcome. In addition, the gaming controller 16 is adapted to determine if the generated outcome is a winning outcome based on the displayed game symbols 88, a pay-table, a wager, and one or more selected paylines 100. More specifically, the gaming machine 12 determines if a combination of symbols 88 arranged along the selected payline 100 is a winning combination. The gaming controller 16 may provide an award in response to the outcome of the main game 80. In general, the term "award" may be a payout, in terms of credits or money. Thus, gaming controller 16 may award a regular payout in response to the outcome of the main game 80. However, it should be noted that the term award may also refer to other types of awards, including, prizes, e.g., meals, show tickets, etc. . . . , as well as in-game awards, such as free games or awarding the player one or more wild symbols or stacked wild symbols in each of the games.

The illustrated embodiment can also include a bonus feature or secondary game in addition to the main game on the gaming machine. The bonus feature or secondary game is an add-on to the main game utilizing any in-game machine asset (discussed in more detail below). A bonus feature or secondary game is considered an add-on to the main game that occurs during game play. The bonus feature or secondary game can used any in-game machine asset that is used to display an award related to the main game. Such awards include free spins, credits, a credit multiplier, or additional pseudo game-play unrelated to the main game. The bonus feature or secondary game can be in any of the wagering or non-wagering formats as described above (slots, video poker, etc.). A bonus feature or secondary game may also be similar to the main game through the use of additional random numbers in order to continue randomized, wager-based game play. A bonus feature or secondary game may include any additional game play and grant awards based on any particularized triggers built into the main game of the game machine. It should be noted that the game may only include the main game 80. Alternatively, the game may include the main game 80 and one or more bonus features and/or one or more secondary games. It should be noted that the present invention is not limited to any specific bonus feature or secondary game (or type thereof). Exemplary bonus features or secondary games are disclosed in U.S. Pat. No. 7,824,260, U.S. Pat. No. 8,052,515, U.S. Pat. No. 8,096,869, U.S. Pat. No. 8,303,397, and U.S. Patent Application Publication No. 2011/0223985, all of which are hereby incorporated by reference.

Player Tracking System and Method

Figure 4:
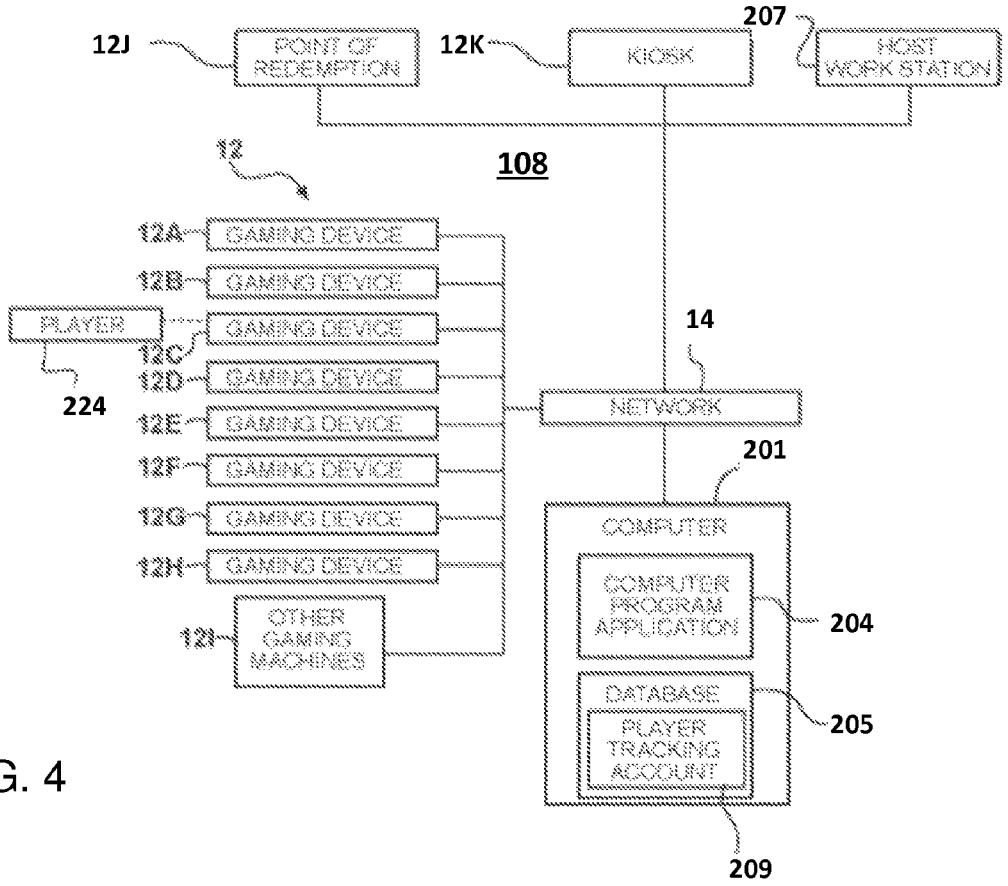
FIG. 4 is a block diagram of the player tracking system according to the first embodiment.
Figure 5:
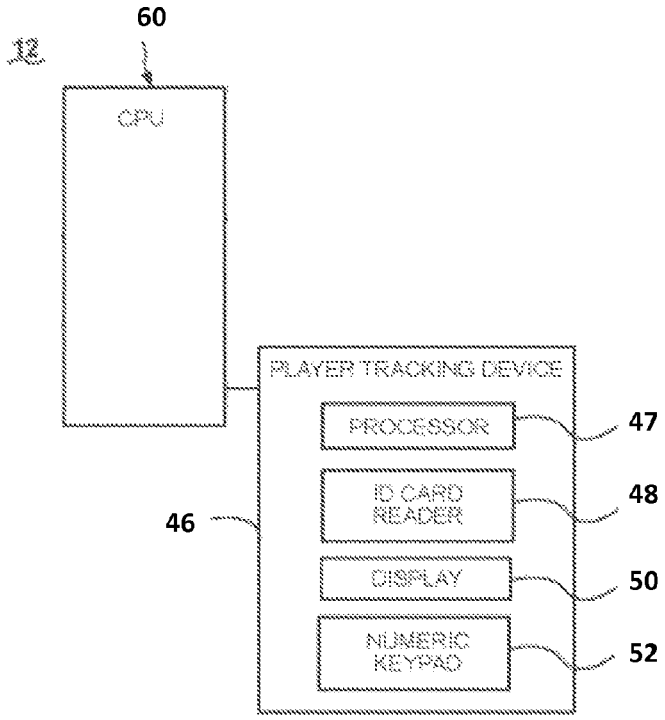
FIG. 5 is a block diagram of a portion of an exemplary player tracking module used in the system of FIG. 1.

In one embodiment, the system controller 10 and method may be embodied or implemented via an entertaining and monitoring system 108 which is shown in block diagram form in FIG. 4. The player tracking system may include additional functions such as, real-time multi-site, slot accounting, player tracking, cage credit and vault, sports book data collection, Point of Sale (POS) accounting, keno accounting, bingo accounting, and table game accounting, a wide area progressive jackpot, and electronic funds transfer (EFT).

As shown, the system 2 includes a plurality of gaming machines 12. Gaming Machines 12 may include, but are not limited to gaming machines, electronic gaming machines (such as video slot, video poker machines, or video arcade games), electric gaming machines, virtual gaming machines, e.g., for online gaming, an interface to a table management system (not shown) for table games, kiosks 12K, point of sale or redemption terminals 12J, or other suitable devices at which a patron may interact or access a user or player account. However, it should be noted that the present invention is not limited to any number or type of gaming machines 12. In one embodiment, the gaming machines 12 are organized into banks (not shown), each bank containing a plurality of gaming machines 12.

Other types of gaming machines which may be included (see above) are indicated with reference number 121.

The gaming machines 12 are connected via a network 14 to one or more host computers or servers 201, which are generally located at a remote or central location. The computer 201 includes a computer program application 204 which maintains one or more player tracking accounts databases 205. The player tracking accounts database 205 may be used to identify a plurality of players across the groups or banks of gaming machines 12 connected to the network 14, whether located in the same property, casino, or at separate, remotely located properties/casinos, in order to award a community award (described below).

The computer program application 201 and databases 205 may be used to record, track, and report accounting information regarding the gaming machines 12 and players 224 of the gaming machines 12. Additionally, the computer program application 204 and database(s) 205 may be used to maintain information related to player or player tracking accounts (see below).

In general, the machines 12 may be used by a user or player, i.e., to access their player account. For example, a gaming machine 12 is playable by a player 224. The player 224 may select one of the gaming machines 12 to play and insert a coin, credit, coupon, and/or player tracking card (not shown) into the chosen gaming machine 12. Generally, the gaming machines 12 have an associated number of credits or coins required in order to play. In the case of video slot or poker games, the game is played and an award in the form of credits may be awarded based on a pay table of the gaming machine 12.

Input to the gaming machine 12 may be accomplished via mechanical switches, buttons 24, or via a display interface 13 (discussed above).

The player 224 is identified via the player tracking card and/or a player identification number entered into player tracking device 46 at each gaming machine 12 (see above). Player tracking accounts may be used, generally, to provide bonuses or player tracking awards, to a player, in addition to the award designated by, in the case of a video slot or poker machine, the gaming machine 12 paytable. These bonuses may be awarded to the player 224 based a set of criteria, including, but not limited to, a) the player's play on the gaming machine 12, b) the player's overall play, c) play during a predetermined period of time, and d) the player's birthday or anniversary, or e) any other definable criteria. Additionally, bonuses may be awarded on a random basis, i.e., to a randomly chosen player or randomly chosen main game 80. Bonuses may also be awarded in a discretionary manner or based on other criteria, such as, purchases made at a gift shop or other affiliated location.

In one embodiment, the player tracking device 46 includes a processor 47, a player identification card reader 48 and/or a numeric keypad 52, and a display 50. In one embodiment, the display 50 is a touchscreen panel and the numeric keypad 52 is implemented thereon.

The player 224 may be identified by entry of a player tracking card into the player identification card reader 48 and/or entry of a player identification number (PIN) on the numeric key pad 52. The play tracking device 46 may also be used to communicate information between the computer 201 and the corresponding gaming machine 12. The player tracking device 46 may also be used to track bonus points, i.e., incentive points or credits, downloaded from the computer 201.

In one aspect of the present invention, each player tracking device 46 is associated with one of the electronic gaming machines 12. The player tracking devices 46 identify patrons interacting with the system 2, for tracking wagers made by the players on the electronic gaming machines 12 and record wager data associated with each wager made by the player and a respective electronic gaming machine 12. In one embodiment, the wager data includes a device type associated with respective gaming machine, an electronic gaming machine identifier, the theoretical hold percentage associated with the respective gaming machine, and an amount of the respective wager. The wager data may also include a player ID and a date/time stamp.

The computer or server 201 is in communication with the player tracking devices 46 and the non-gaming terminals 121, 12J, 12K for receiving the wager data associated with the patrons and the respective gaming machine 12 from the player tracking device 46 and storing the wager data in the database 205 and, for receiving transaction data associated with a transaction associated with the patrons' use of the non-gaming terminals 121, 12J, 12K and storing the transaction data in the database. The computer 201 may also establishes a player rating associated with each player as a function of the wager data and the transaction data.

In one aspect of the present invention, the bonuses are awarded as bonus points. In one embodiment, the bonus points are incentive points. In another embodiment, the bonus points are credits.

The incentive points may be converted to credits using a predetermined ratio. The predetermined ratio may be 1 or any other desired ratio. The predetermined ratio may also be varied based on determined criteria, e.g., the gaming machine 12 being played, the player, or the time of day. Incentive points may be designated as cashable or non-cashable. As described below, the incentive points in a player account may be downloaded to one of the gaming machines 12 for play.

Incentive points stored in the player account may be designated as cashable or non-cashable. In one embodiment, the player account may include only cashable incentive points. In another embodiment, the player account may include only non-cashable incentive points. In a third embodiment, the player account may include both cashable and non-cashable incentive points. In still another embodiment, the player account may include incentive points, cashable and/or non-cashable, and credits, cashable and/or non-cashable. Cashable credits, or incentive points converted into credits, may be downloaded to a gaming machine 12. When the player has finished playing the gaming machine 12, any remaining credits may be cashed out, i.e., retrieved as coins or placed on a printed ticket or player tracking card for redemption or play on another gaming machine 12.

Non-cashable credits must be played. When the player stops playing gaming machine 12C, any remaining non-cashable credits which were downloaded to the gaming machine 12C are either lost or uploaded back to the player account (see below).

The database 205 tracks the player account for each player in the player tracking system. In the illustrated example, the following is tracked for each player: account number, incentive points, name, cashable credits and non-cashable credits. Thus in this example, bonus points in the form of incentive points, cashable credits and non-cashable credits may be awarded.

In one aspect of the present invention, bonus points are awarded via electronic vouchers, i.e., records in the database 205. A voucher is created each time bonus points are awarded. Each voucher has a voucher number and an amount (in the case a dollar or credit amount). Each voucher is assigned to a player account and includes the player account number to which it is assigned. Each voucher may include additional parameters or fields based on the needs of the system 2. For example, an expiration date could be included which gives a date at which the respective voucher expires. The voucher may also designate the bonus points as cashable or non-cashable.

In one aspect of the present invention the computer 201 may create a first voucher and assign a first number of bonus points to the first voucher. The computer 201 may also create a second voucher and assign a second number of bonus points to the second voucher. The first and second vouchers may be assigned to a player account. Each voucher has a parameter. The parameter of the first voucher has a first value and the parameter of the second voucher has a second value.

In one embodiment, the bonus points are incentive points which may be converted to credits and downloaded to the gaming machine 12. In another embodiment, the bonus points are credits which may be downloaded to the gaming machine 12.

In one embodiment, the gaming machine 12 may display to the player 224 a list of the vouchers which have been assigned to their player account. The player 224 may then indicate at least one voucher to download. The list may displayed whenever appropriate, for example, when the player 224 is identified to the system 2, when the player requests the list (through a menu system), when a new voucher has been created, or any other suitable time. In one embodiment, the list may be displayed on the display 13. In another embodiment, the list may be displayed on the player tracking device display 50.

The first and second values of the parameters of the first and second vouchers may be equal or different. For example, in one embodiment the parameter relates to an expiration date of the respective voucher. The expiration date may be a function of the date of the voucher was created. Thus, the expiration dates of the first and second vouchers may be different if the vouchers were created on different days or may be the same if created on the same day.

In another embodiment, the parameter is one of cashable and non-cashable. The computer 18 may designed a voucher as cashable or non-cashable. Typically, this is defined by predefined criteria based on how the voucher was created. If the bonus points for a specific voucher are incentive points, the incentive points may be converted to credits prior to downloading to the gamine machine 12. As described above, this is done using a predetermined ration which may be 1 or some other ratio.

In one embodiment, the gaming machine 12 may provide an indication to the player 224 when the first voucher or second voucher has been assigned to the player account. For example, the indication may be an audio signal and/or a visual signal.

In one embodiment, the parameter may be an expiration date of the respective voucher. Each voucher may also include a second parameter designating the respective bonus points as being cashable or non-cashable.

In one embodiment, the computer 201 may convert the first number of bonus points to a first number of credits and download the first number of credits to the player tracking device 46.

In another embodiment, the gaming machine 12 has a credit meter for tracking available credits for play of the gaming machine by the player 224. The computer 201 may convert the first number of bonus points to a first number of credits and download the first number of credits to the credit controller 62.

In one embodiment, the parameter may be one lump-sum and pay for play. The computer 201 may convert the first number of bonus points to credits and download the credits to the credit meter if the first voucher is designated as lump-sum.

In one embodiment of the present invention, the gaming machine 12 is capable of accepting a variable wager. The variable wager has a maximum wager value or MAX BET. In one embodiment, the maximum wager value is equal to the lesser of a value defined by the configuration of the gaming machine 12, a value defined by the incentive setup, or the remaining balance of bonus points. The computer 201 converts the first number of bonus points associated with the first voucher to a first number of credits and downloads the first number of bonus points to the player tracking device 46 as credits. The gaming machine 12 allows the player 224 to place a wager and play the gaming machine 12. The gaming machine 12 decrements the wager from the credit meter, decrements the maximum wager from the player tracking device 46, and credits the maximum wager to the credit meter in response to the player 224 playing the gaming machine 12.

In another embodiment of the present invention, the player account is credited with a first number of bonus points. The bonus points are downloaded to the player tracking device 38 as credits. The player 224 places a wager and the gaming machine 12 is played. If the total of the player's wagers (over one or more games) is greater or equal to a predetermined value, i.e., a predetermined match play amount, then the match play amount is decremented from the player tracking device 46 and the match play amount is credited to the credit meter. Otherwise, the player 224 may place another wager.

In one aspect of the present invention, the player tracking device 46 provides an interface for interaction between the player 224 or other user (not shown), such as a slot employee or slot technician, and the host computer 18, i.e., player tracking system. As discussed above in one embodiment, the display 50 is a touchscreen display which allows information to be displayed to the player 224 or user, as well as provide interactive buttons or menus for receiving input. Furthermore, the keypad 52 may be implemented on the display 50 and displayed on the display 50 as appropriate or required.

Furthermore, as discussed above, the player tracking device 38 may display a list of vouchers assigned to the player 24. The player 24 may be allowed to select a voucher, or a number of available bonus points or credits, to download. Once the player selects a voucher or a number of credits or points to download, the credits may be downloaded to the credit meter on the gaming machine 12 and are then available for use.

Community Award System and Method

In general, the present embodiment of the invention discloses a system 2 in order to grant a community award to a player. The system comprises a plurality of gaming machines 12 and a system controller 10. Each gaming machine is configured receive a wager from a player and initiate a game for play by a player. The system controller is coupled to each of the gaming machines and includes a database with a community awards list and a plurality of total award amounts associated with a corresponding number of players. The system controller is then configured to detect a triggering condition as a function of the received wagers; responsively determine a number of players playing the plurality of gaming machines; further determine a total award as a function of the determined number of players and the community award list; and provide a community award being equal to at least one player as a function of the determined total award.

In one embodiment, the system controller 10 may be implemented independently, utilizing the network 14 to maintain communication with the plurality of gaming machines 12. In another embodiment, the system controller may be incorporated within the player tracking system 108 (as discussed above). This would grant full integration between the system controller handling the community award and the player tracking system 108. The incorporation of the system controller 10 and the player tracking system 108 can occur through the computer server 201 or through any additional component that may be in communication through the network 14. In another embodiment, the system controller 10 may also be included within the game controller 16 incorporated within each gaming machine 12. This would allow for the implementation of the community award via ad-hoc communication between gaming machines 12 that are not connected to a network 14.

Dynamic Total Award

In one embodiment, the community award list can comprise any type of award type amount that can change as a function of the number of players playing the gaming machines that are attached to the system controller. These total award amounts correspond to the number of players actively playing on the gaming machines and therefore affect the rankings that are determined by the system controller. For example, a community award list that demonstrates a changing top award amount as a function of the number of players may be provided in the following chart.

| | 8 players | 7 players | 6 players | 5 players | 4 players | 3 players | 2 players | 1 player |
|---|---|---|---|---|---|---|---|---|
| Top award | $500 | $250 | $100 | $50 | $40 | $30 | $20 | $10 |
| 2nd award | $250 | $100 | $50 | $40 | $30 | $20 | $10 | N/A |
| 3rd award | $100 | $50 | $40 | $30 | $20 | $10 | N/A | N/A |
| 4th award | $50 | $40 | $30 | $20 | $10 | N/A | N/A | N/A |
| 5th award | $40 | $30 | $20 | $10 | N/A | N/A | N/A | N/A |
| 6th award | $30 | $20 | $10 | N/A | N/A | N/A | N/A | N/A |
| 7th award | $20 | $10 | N/A | N/A | N/A | N/A | N/A | N/A |
| 8th award | $10 | N/A | N/A | N/A | N/A | N/A | N/A | N/A |

The horizontal top row represents the number of players that have actively triggered the system controller through gaming machines. The vertical row represents the possible total award amounts based on ranking. Based on this example chart one can see the how the system controller can access variable total award amounts a function of the amount of players in the system.

In another embodiment of the present invention, the system controller 10 may be configured to provide a community award to the determined players 224 as function of the determined total award with each community award being equal to a portion of the determined total award. This would allow for granting an equal community award to all players currently interacting with the system 2 as function of the total award previously measured by the number of active players.

In another embodiment of the present invention, the system controller 10 may be configured to determine the ranking for each player and provide the community award based on that ranking. This allows for different methods of granting the community award among the plurality of players currently interacting with the system. Said ranking can be determined by the gaming machines 12, the system controller 10, or any other device in communication with the network 14.

In another embodiment of the present invention, the system controller 10 may be configured to determine the player's ranking based on an associated player rating. This rating can be determined by the gaming machines 12, the system controller 10, or any other device in communication with the network 14.

In another embodiment of the present invention, the system controller 10 may be connected to a player tracking system and configured to determine the player rating as a function of a plurality of predefined criteria from the player tracking system 108. Such criteria may include prior player history, non-gaming activity, pre-coded player metrics, or any other predefined criteria defined within the system 2.

In another embodiment of the present invention, the system controller 10 may be configured to award a single award amount as a function of the number of players interacting with the system. This single award may be awarded to the top-ranked player (based on the ranking embodiment above), or to another player based on other gaming mechanics built into the system.

In another embodiment of the present invention, the system controller 10 may be configured to award a set of player awards, with each set amount corresponding to the number of player initiating the gaming machines 12. This embodiment will allow for granting multiple awards, instead of single total award, as a function of the number of players in the system.

In another embodiment of the present invention, the player awards can be of varying size.

In another embodiment of the present invention, the system controller 10 may be configured to determine the player awards based on the player rankings (discussed above). This will grant larger player awards to higher ranked players as a function of various predefined criteria (also discussed above).

Figure 6:
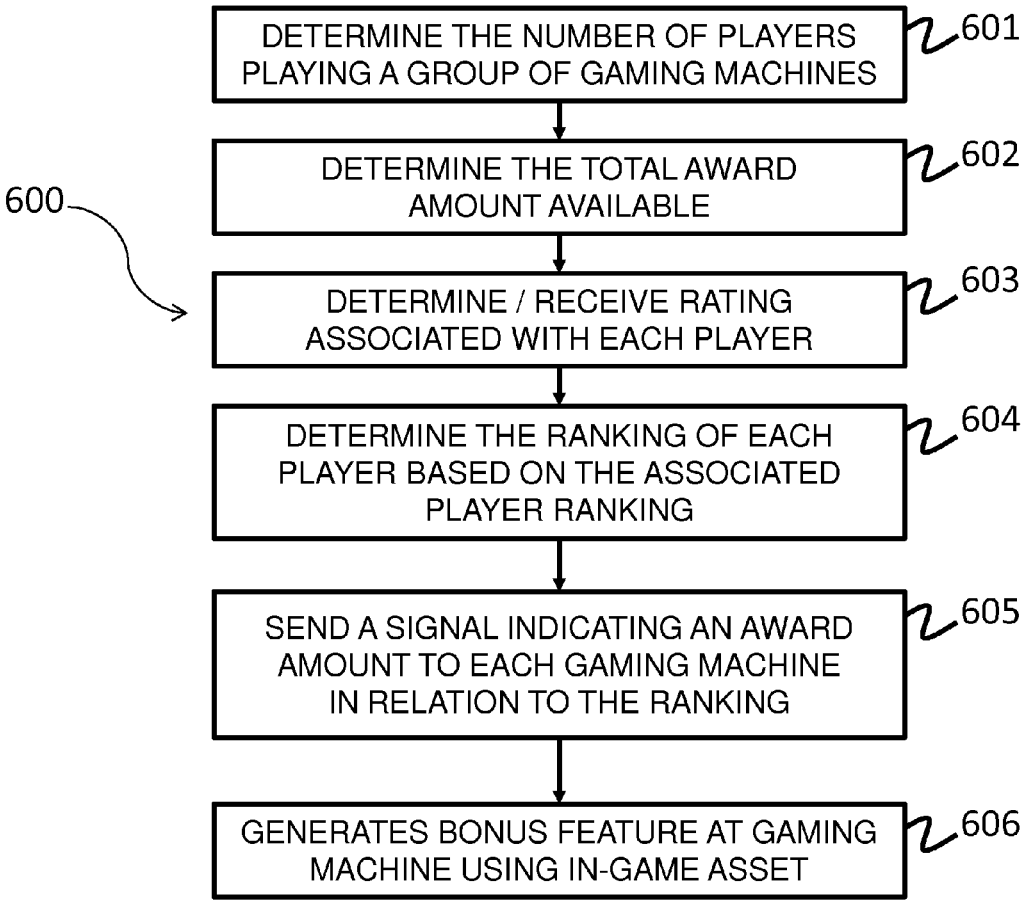
FIG. 6 is a flowchart of a method for awarding a community award through a dynamic paytable, according to an embodiment of the present invention.

FIG. 6 is a flow diagram of a method 600 performed by the system in order to grant a community award to a player through the system detailed in FIG. 1. Initially, at step 601, the system controller 10 determines the number of players playing the group of gaming machines. This occurs through the system controller 10 receiving a trigger from the plurality of gaming machines 12. The trigger can be through the player 224 interacting with any of the input mechanisms built into the gaming machines 12, such as the display 13, the buttons 24, or the counter/acceptor 28/26. Then, at step 602, the system controller determines the total award amounts available. As shown in the example table above, the system controller can access the available total award amounts available for the given number of players currently in the system. Next, the system controller determines or receives a rating associated with each player at step 603. The rating may be generated by the system controller 10 or produced by the controller through a separate player tracking system 108.

In another embodiment, the system controller can use pre-coded criteria or player-generated transactions in order generate the ratings for each player. Pre-coded criteria or player-generated transactions can be directly by the system controller or inputted by the player tracking system. Such pre-coded metrics can include a player's particular gambling status, birthdate, etc. Player-generated transactions can involve a player's gambling history as collected by the gaming machines 12 or additional non-wagering machines connected to the system.

Next, the system controller determines the ranking of each player based on the associated player ranking at step 604. This is based on the corresponding total award amount or probabilities found within the community award lists in the system controller. Here, the system controller can have a variety of different total award amounts depending on how the community awards list is set up. The community award list could have only one award for the top ranked player or a have multiple awards for each particular ranking that is presently active.

Based on the particular set of the community award list, the system controller will then send a signal indicating the appropriate award amounts to each active gaming machine in relation to the ranking at step 605. Finally, at step 606, the gaming machine received the award amount signal and distributes the appropriate award to the player.

Dynamic Probability

In another aspect of the present invention, a system providing a community award to player is disclosed. The system comprises a plurality of gaming machines and a system controller. Each gaming machine is configured receive a wager from a respective player and responsively initiate a game. The system controller is coupled to each of the gaming machines and includes a database with a community awards list including a plurality of total award probabilities, each total award probability associated with a corresponding number of players. The system controller is then configured to detect a triggering condition; responsively determine a number of players playing the plurality of gaming machines; determine a total award probability as a function of the determined number of players and the community award list; and provide a community award to at least one of the plurality of players as a function of the determined total award probability.

In another embodiment of the present invention, the system controller 10 may be configured to provide a community award to the determined players 224 as function of the determined total award probability with each community award being equal to a portion of the determined community. This would allow for granting an equal community awards to all players currently interacting with the system 2 as function of the total award probability previously measured by the number of active players. The total award probability can be triggered by one player in order to grant the award to all players or can be required by players in order to receive their prospective community award.

In another embodiment of the present invention, the system controller 10 may be configured to determine the ranking for each player and provide the community award based on that ranking. This allows for different methods of granting the community award among the plurality of players currently interacting with the system. Said ranking can be determined by the gaming machines 12, the system controller 10, or any other device in communication with the network 14.

In another embodiment of the present invention, the system controller 10 may be configured to determine the player's ranking based on an associated player rating. This rating can be determined by the gaming machines 12, the system controller 10, or any other device in communication with the network 14.

In another embodiment of the present invention, the system controller 10 may be connected to a player tracking system and configured to determine the player rating as a function of a plurality of predefined criteria from the player tracking system 108. Such criteria may include prior player history, non-gaming activity, pre-coded player metrics, or any other predefined criteria defined within the system 2.

In another embodiment of the present invention, the system controller 10 may be configured to award a single community award amount as a function of the number of players interacting with the system. This single community award may be awarded to the top-ranked player (based on the ranking embodiment above), or to another player based on other gaming mechanics built into the system.

Figure 7:
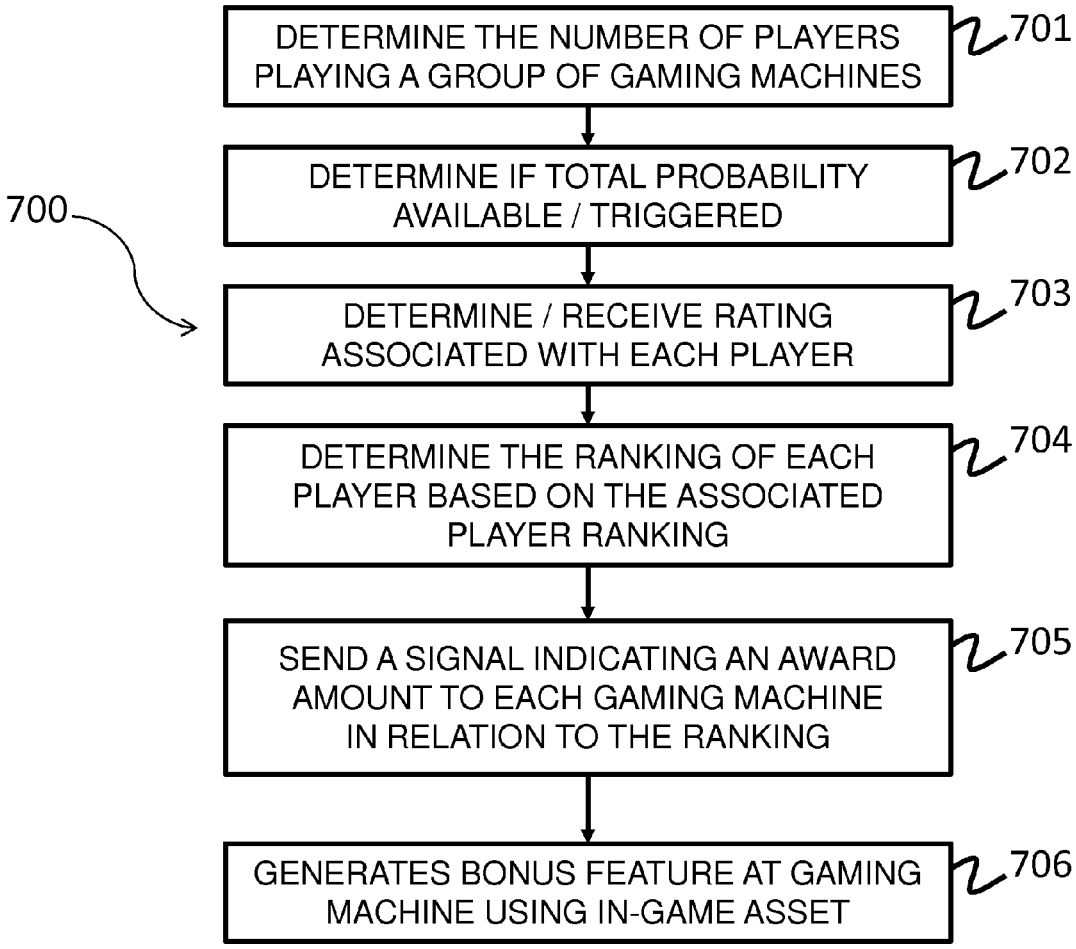
FIG. 7 is a flowchart of a method for awarding a community award through a dynamic probability, according to an embodiment of the present invention.

FIG. 7 is a flow diagram of a method 700 performed by the system in order to grant a community award to a player through the system detailed in FIG. 1. This particular embodiment utilizes changing probabilities that are a function of the number of players attached to the system in order to grant the community award amount.

Initially, at step 701, the system controller 10 determines the number of players playing the group of gaming machines. This occurs through the system controller 10 receiving a trigger from the plurality of gaming machines 12. The trigger can be through the player 224 interacting with any of the input mechanisms built into the gaming machines 12, such as the display 13, the buttons 24, or the counter/acceptor 28/26. Then, at step 702, the system controller determines the total award probabilities available. Unlike the Dynamic Paytable embodiment above, the probabilities linked to the community award list only increase the chances of a particular set of player winning the particular community established by the game machine 12. This community award can be predetermined or result from a system award granted through the system controller 10. Also, the community award may consist of a single award for a particular player currently playing one of the gaming machines 12 or a larger community award granted to all players attached to gaming machines 12.

Next, the system controller determines or receives a rating associated with each player at step 603. The rating may be generated by the system controller 10 or produced by the controller through a separate player tracking system 108.

In another embodiment, the system controller can use pre-coded criteria or player-generated transactions in order generate the ratings for each player. Pre-coded criteria or player-generated transactions can be directly by the system controller or inputted by the player tracking system. Such pre-coded metrics can include a player's particular gambling status, birthdate, etc. Player-generated transactions can involve a player's gambling history as collected by the gaming machines 12 or additional non-wagering machines connected to the system.

Next, the system controller determines the ranking of each player based on the associated player ranking at step 704. A community award based on a dynamic probability will require a ranking in order to grant the award to the top-ranked player once the community award is triggered within the system. Otherwise, the system will note to send a corresponding community award amount to every machine that currently attached to the system once the appropriate community award probability is triggered.

Based on the particular set of the community award list, the system controller will then send a signal indicating the appropriate award amounts to each active gaming machine in relation to the ranking at step 705. Finally, at step 706, the gaming machine received the award amount signal and distributes the appropriate award to the player.

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A system, comprising:

a plurality of wagering gaming machines playable by a plurality of players, each of the wagering gaming machines including an acceptor device which accepts physical media associated with a monetary value to establish a credit balance, a display device for displaying a game, a random number generator; a non-transitory memory device having computer executable instructions stored thereon, and a processor configured to receive a signal indicative of a wager from a player via the input device, adjust the credit balance as a function of the wager, and initiate the game, the wagering gaming machine configured to receive a wager amount from a respective player and responsively initiate a game;

a database, the database including:

a table comprising a community awards list including a plurality of total award records, each total award record including a predetermined total award amount, an associated number of players, and a set of community player awards corresponding to the associated number of players, each total award record including a different total number of players and a different predetermined total award amount; and a plurality of player tracking accounts, each account associated with at least one player;

a system controller, the system controller coupled to each of the gaming machines and the database, the system controller configured to:

track the gaming activity of a player on at least one of the plurality of wagering gaming machines;

detect a triggering condition on at least one of the plurality of wagering gaming machines as a function of the tracked gaming activity of a player, and in response to the triggering condition being detected from at least one of the plurality of wagering gaming machines, perform the following:

determine a number of current players playing the plurality of gaming machines at the time of the triggering condition;

access the community award list and select a single predetermined total award amount associated with the determined number of current players from the plurality of total award amounts listed in the community award list;

determine the set of community player awards associated with the selected single predetermined award amount and provide a community player award from the determined set of community player awards to each player included in the number of current players such that a total amount of the community player awards being provided to the number of current players is equal to the determined total award amount; and place each community player award in the corresponding player tracking account associated with each current player.

2. A system in accordance with claim 1 wherein each community player award includes a different award value.

3. A system in accordance with claim 1, the system controller configured to determine a ranking for each player within the plurality of players and provide the community player awards as a function of the determined ranking.

4. A system in accordance with claim 3, the system controller configured to determine the ranking based on an associated player rating.

5. A system in accordance with claim 4, wherein the system controller is connected to a player tracking system, the system controller configured to determine the player rating as a function of a plurality of predefined criteria from the player tracking system.

6. The system of claim 5, wherein the predefined criteria includes pre-coded metrics and accumulated transactions inputted into the player tracking system.

7. A system in accordance with claim 1, the system controller configured to randomly select each community player award for each current player.

8. A system in accordance with claim 3, the system controller configured to provide a community player award having a maximum award value to the top-ranked player.

9. The system of claim 1, wherein each community player award includes an equal award value.

10. The system of claim 1, wherein the set of community player awards comprises a first player award and second player award, the first player award being larger than the second player award.

11. The system of claim 1, wherein each total award record includes award probabilities associated with each player included in the corresponding number of players, the system controller configured to determine an award probability associated with each current player and randomly determine whether to provide a community player award to a corresponding current player as a function of the associated award probability.

12. A method including a plurality of wagering gaming machines, each of the wagering gaming machines including an acceptor device which accepts physical media associated with a monetary value to establish a credit balance, a display device for displaying a game, a random number generator, a non-transitory memory device having computer-executable instructions stored thereon, and a processor configured to receive a signal indicative of a wager from a player via the input device, adjust the credit balance as a function of the wager, and initiate the game, the method also including a system controller and a database, the database including a table comprising a community awards list including a plurality of total award records, each total award record a predetermined total award amount, an associated number of players, and a set of community player awards corresponding to the associated number of players, each total award record including a different total number of players and a different predetermined total award amount, and the database also including a plurality of player tracking accounts, each account associated with at least one player, the method comprising the steps of:

receiving, through the processor, a wager amount through at least one wagering gaming machine from a respective player;

initiating, through the processor, a game on the at least one wagering game machine;

tracking, through the system controller, the gaming activity of a player on at least one wagering gaming machine;

detecting a trigger condition by the system controller as a function of the tracked gaming activity on at least one wagering gaming machine, and in response to the trigger condition being detected, perform the following steps:

determining, by the system controller, a number of current players playing the plurality of machines at the time of the triggering condition;

accessing the community awards list stored in the database and selecting, by the system controller, a single predetermined total award amount associated with the determined number of current players from the plurality of total award amounts listed in the community award list;

determining the set of community player awards associated with the selected single predetermined award amount and providing, by the system controller, a community player award from the determined set of community player awards to each player included in the number of current players such that a total amount of the community player awards being provided to the number of current players is equal to the determined total award amount; and placing each community player award in the corresponding player tracking account associated with each current player.

13. The method of claim 12, wherein each community player award includes a different award value.

14. The method of claim 12, further including the steps of:

determining, by the system controller, the ranking for each player within the plurality of players; and providing, by the system controller, the community player awards as a function of the determined ranking.

15. The method of claim 14, further including the step of the system controller determining the ranking based on an associated player rating.

16. The method of claim 15, further including a player tracking system connected to the system controller and comprising the step of the system controller determining the player rating as a function of a plurality of predefined criteria from the player tracking system.

17. The method of claim 16, wherein the predefined criteria includes pre-coded metrics and accumulated transactions inputted into the player tracking system.

18. The method of claim 14, including the step of randomly select each community player award for each current player.

19. The method of claim 14, further including the step of the system controller providing a community player award having a maximum award value to the top-ranked player.

20. The method of claim 12, wherein each community player award includes an equal award value.

21. The method of claim 12, wherein the set of community player awards comprises a first player award and second player award, the first player award being larger than the second player award.

22. The method of claim 12, wherein each total award record includes award probabilities associated with each player included in the corresponding number of players, the method includes the steps of determining an award probability associated with each current player and randomly determining whether to provide a community player award to a corresponding current player as a function of the associated award probability.

23. A non-transitory information recording medium on which a computer-readable program is recorded that causes a computer to function as a system comprising:

a system controller, the system controller coupled to a plurality of wagering gaming machines playable by a plurality of players, each of the wagering gaming machines including an acceptor device which accepts physical media associated with a monetary value to establish a credit balance, a display device for displaying a game, a random number generator; a non-transitory memory device having computer-executable instructions stored thereon; and a processor configured to receive a signal indicative of a wager from a player via the input device, adjust the credit balance as a function of the wager, and initiate the game, the wagering gaming machine configured to receive a wager amount from a respective player and responsively initiate a game and a database, the database including a table comprising a community awards list including a plurality of total award records, each total award record including a predetermined total award amount, an associated number of players, and a set of community player awards corresponding to the associated number of players, each total award record including a different total number of players and a different predetermined total award amount, and a plurality of player tracking accounts, each account associated with at least one player, the system controller configured to:

track the gaming activity of a player on at least one of the plurality of wagering gaming machines;

detect a triggering condition on at least one of the plurality of wagering gaming machines as a function of the tracked gaming activity of a player, and in response to the trigger condition being detected from at least one of the plurality of wagering gaming machines, perform the following:

determine a number of current players playing the plurality of gaming machines at the time of the triggering condition;

access the community award list and select a single predetermined total award amount associated with the determined number of current players from the plurality of total award amounts listed in the community award list;

determine the set of community player awards associated with the selected single predetermined award amount and provide a community player award from the determined set of community player awards to each player included in the number of current players such that a total amount of the community player awards being provided to the number of current players is equal to the determined total award amount; and place each community player award in the corresponding player tracking account associated with each current player.

* * * * *